US012535304B2

(12) United States Patent
Sadler et al.

(10) Patent No.: US 12,535,304 B2
(45) Date of Patent: Jan. 27, 2026

(54) MULTIPLE SHAPED CHARGE JET (SCJ) WARHEAD

(71) Applicant: Raytheon Company, Arlington, VA (US)

(72) Inventors: Coulton T. Sadler, Tucson, AZ (US); Brian J. Lukow, Tucson, AZ (US); Christopher M. Turner, Oro Valley, AZ (US); Michael R. Johnson, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/742,564

(22) Filed: Jun. 13, 2024

(65) Prior Publication Data

US 2025/0383186 A1 Dec. 18, 2025

(51) Int. Cl.
*F42B 1/02* (2006.01)
*F42B 1/028* (2006.01)
(Continued)

(52) U.S. Cl.
CPC ..... *F42B 1/028* (2013.01); *F42B 1/02* (2013.01); *F42B 12/10* (2013.01); *F42B 12/16* (2013.01)

(58) Field of Classification Search
CPC .. F42B 1/028; F42B 1/04; F42B 12/08; F42B 12/10; F42B 12/14
See application file for complete search history.

(56) References Cited

U.S. PATENT DOCUMENTS 2,494,256 A * 1/1950 Muskat ..... C10G 61/06 175/4.54
2,725,821 A 12/1955 Coleman
(Continued)

FOREIGN PATENT DOCUMENTS

CN 105389415 B 8/2018
CN 107024149 B 8/2018
(Continued)

OTHER PUBLICATIONS

Fong, Richard, et al., "Multiple Explosively Formed Penetrator (MEFP) Warhead Technology Development", (Dec. 2004), 3 pgs.
(Continued)

*Primary Examiner* — Derrick R Morgan
(74) *Attorney, Agent, or Firm* — Schwegman Lundberg & Woessner, P.A.

(57) ABSTRACT

In a MSCJ warhead detonation of the main charge is controlled to provide elevated pressure at multiple locations on the back surface of the liner to cut the liner and to form and propel forward a plurality of SCJs. An initiation system is configured for multi-point initiation of a plurality of booster charges to detonate the main charge to produce a plurality of detonation waves that constructively interfere at multiple locations on the back surface of the liner to form pressure hot spots that cut the liner and to form and propel forward a plurality of SCJs. In different embodiments, the elevated pressures are between 110% and 200% of the detonation pressure at the front of an individual detonation wave. The liner may, for example, include a plurality of recesses such as shallow dimples or deeper conical structures in which case the boosters are aligned to the center of the recessed structures.

16 Claims, 9 Drawing Sheets

(51) Int. Cl.
*F42B 12/10* (2006.01)
*F42B 12/16* (2006.01)

(56) References Cited

U.S. PATENT DOCUMENTS 2,757,611 A * 8/1956 Church ..... F42B 1/024 102/307
2,763,210 A * 9/1956 Church ..... F42B 1/02 102/307
2,831,429 A * 4/1958 Moore ..... F42B 3/08 102/307
2,856,850 A * 10/1958 Church ..... F42B 1/02 29/421.2
2,984,307 A * 5/1961 Barnes ..... F42B 3/08 102/307
3,145,656 A * 8/1964 Cook ..... F42B 12/14 102/307
3,241,488 A * 3/1966 Glass ..... E21B 43/117 102/310
3,244,102 A * 4/1966 Wofford, III ..... F42B 3/08 102/307
3,347,164 A * 10/1967 Baks et al. ..... F42B 3/08 102/318
3,443,518 A * 5/1969 Cross ..... F42B 3/00 102/306
3,477,372 A * 11/1969 Nelson ..... F42B 3/08 102/307
3,490,372 A 1/1970 Lavine
3,613,579 A * 10/1971 Wales, Jr. ..... F42C 1/14 102/396
3,847,080 A * 11/1974 Eckels ..... F42D 3/04 102/311
3,902,422 A 9/1975 Coursen
3,974,771 A * 8/1976 Thomanek ..... F42B 12/14 102/494
3,978,796 A 9/1976 Hackman
4,018,163 A 4/1977 Brown
4,043,266 A * 8/1977 Held ..... F42B 12/14 102/306
4,160,415 A * 7/1979 Cole ..... F42C 13/04 102/513
4,406,226 A 9/1983 Davitt et al.
4,499,830 A * 2/1985 Majerus ..... F42B 1/032 102/307
4,510,870 A * 4/1985 Walters ..... F42B 1/028 102/307
4,516,501 A 5/1985 Held et al.
4,649,828 A 3/1987 Henderson et al.
4,770,097 A 9/1988 Wilson et al.
4,823,701 A * 4/1989 Wilhelm ..... F42B 12/22 102/495
4,892,039 A 1/1990 Emerson et al.
4,896,609 A 1/1990 Betts et al.
4,915,029 A 4/1990 Appledorn et al.
4,960,171 A 10/1990 Parrott et al.
5,038,683 A 8/1991 Baker et al.
5,229,542 A * 7/1993 Bryan ..... F42B 12/204 102/478
5,320,044 A * 6/1994 Walters ..... F42B 1/028 102/306
5,359,935 A * 11/1994 Willett ..... F42B 1/00 299/13
5,479,860 A 1/1996 Ellis
5,531,164 A 7/1996 Mosley
5,540,156 A 7/1996 Fong
5,700,969 A 12/1997 Mosley
5,714,712 A 2/1998 Ewick et al.
5,939,663 A 8/1999 Walters et al.
6,155,155 A * 12/2000 Moshier ..... F42B 12/22 89/1.13
6,186,070 B1 * 2/2001 Fong ..... F42B 12/10 102/476
6,220,167 B1 4/2001 Yamamoto et al.
6,393,991 B1 5/2002 Funston et al.
6,457,416 B1 10/2002 Micke et al.
6,494,139 B1 * 12/2002 Powell ..... F42B 12/10 175/4.6
6,505,559 B1 * 1/2003 Joslin ..... F42D 3/00 102/307
6,510,797 B1 * 1/2003 Fong ..... F42B 1/028 102/501
6,606,951 B1 8/2003 Klein
6,772,105 B1 8/2004 Heck, Sr.
7,047,886 B2 5/2006 Micke et al.
7,418,373 B2 8/2008 Heck, Sr.
7,658,150 B2 * 2/2010 Ronn ..... F42B 1/02 102/306
7,661,367 B2 * 2/2010 Yang ..... F42B 3/08 102/306
7,913,758 B2 * 3/2011 Wheller ..... E21B 43/117 166/259
8,127,686 B2 3/2012 Lloyd
8,380,436 B2 2/2013 Heck, Sr.
8,393,393 B2 3/2013 Rodgers et al.
8,397,800 B2 3/2013 Rodgers et al.
8,397,814 B2 3/2013 Rodgers et al.
8,408,286 B2 4/2013 Rodgers et al.
8,418,623 B2 4/2013 Lloyd
8,490,686 B2 7/2013 Rodgers et al.
8,538,698 B2 9/2013 Heck, Sr.
8,714,251 B2 5/2014 Glenn et al.
8,714,252 B2 5/2014 Glenn et al.
8,875,796 B2 11/2014 Hales et al.
8,881,816 B2 11/2014 Glenn et al.
8,899,320 B2 12/2014 Le
8,978,749 B2 3/2015 Rodgers et al.
8,978,817 B2 3/2015 Rodgers et al.
8,985,200 B2 3/2015 Rodgers et al.
9,091,152 B2 7/2015 Rodgers et al.
9,206,675 B2 12/2015 Hales et al.
9,297,228 B2 3/2016 Martinez et al.
9,428,979 B2 * 8/2016 Bell ..... F42B 3/006
9,447,678 B2 9/2016 Walter et al.
9,598,940 B2 3/2017 Rodgers et al.
9,909,408 B2 3/2018 Rodgers et al.
9,926,777 B2 3/2018 Rodgers et al.
9,995,562 B2 * 6/2018 Jennett ..... F42B 12/22
10,000,994 B1 * 6/2018 Sites ..... E21B 43/117
10,443,361 B2 * 10/2019 Sites ..... E21B 43/117
10,458,761 B2 * 10/2019 Collier ..... F42C 19/0846
2005/0126420 A1 * 6/2005 Givens ..... F42D 3/00 102/310
2007/0240599 A1 * 10/2007 Pratt ..... F42D 3/04 102/307
2007/0263759 A1 * 11/2007 Melin ..... H05H 1/52 376/132
2018/0252507 A1 * 9/2018 Collier ..... E21B 43/117
2022/0154559 A1 * 5/2022 Sadler ..... E21B 43/117
2024/0361110 A1 * 10/2024 Sadler ..... F42B 12/22

FOREIGN PATENT DOCUMENTS

CN 111964545 A 11/2020
EP 3167147 B1 1/2020
FR 1328393 A * 5/1962
WO WO-9951932 A2 * 10/1999 ..... F41B 3/04

OTHER PUBLICATIONS

Liu, Jie, et al., "A study on the surface overpressure distribution and formation of a double curvature liner under a two-point initiation", Defence Technology, vol. 18, Issue 1, (Jan. 2022), 148-157.
"U.S. Appl. No. 18/742,598, Non Final Office Action mailed Jul. 14, 2025", 7 pgs.

* cited by examiner

MULTIPLE SHAPED CHARGE JET (SCJ) WARHEAD

BACKGROUND

Field

This disclosure relates to a multiple Shaped Charge Jet (SCJ) Warhead.

Description of the Related Art

Shape-forming charges are explosive charges shaped to focus the effect of the explosive's energy in specific direction and are purely kinetic in nature. A shape-forming charge is composed of two major components: an explosive charge and a metal liner on a forward surface of the explosive charge. Shape-forming charges may be used to penetrate armor, punch holes in naval vessels such as surface ships or submarines or to perforate wells in the oil and gas industry.

One type of shape-forming charge is referred to as a shaped charge. In a unitary shaped charge, the shaped charge liner has an "apex angle" of 60° or less about an axis of the warhead (e.g., a conical shaped liner along the axis of the warhead). Upon detonation, the liner material collapses toward the centerline and is projected forward as both a slug and a metal jet. The slug makes up approximately 75% of the liner mass and has minimal penetration. The metal jet tip travels much faster than the slug (at least 2×) and thus has much greater penetration capabilities than the slug.

A central detonator, array of detonators or detonation waveguide shape the detonation wave(s) into a plane wave that strikes the metal liner to form the slug and metal jet. The enormous pressure at the front of the plane wave generated by the detonation of the explosive drives the liner in the hollow cavity inward to collapse upon its central axis to project a high-velocity jet of metal particles forward along the axis.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a multiple SCJ (MSCJ) warhead in which detonation of the main charge is controlled to provide elevated pressure at multiple locations on the back surface of the liner to cut the liner and to form and propel forward a plurality of SCJs.

In an embodiment, a warhead includes a liner on a top surface of a main charge and a plurality of booster charges spaced apart on a bottom surface of the main charge. An initiation system is configured for multi-point initiation of the plurality of booster charges to detonate the main charge to produce a plurality of detonation waves that constructively interfere at multiple locations on the back surface of the liner to cut the liner and to form and propel forward a plurality of SCJs. In different embodiments, the elevated pressures are between 110% and 200% of the detonation pressure at the front of an individual detonation wave.

In an embodiment, pairs of directly adjacent detonation waves produce the multiple locations in a non-planar wave within a defined distance range from the plurality of booster charges. The liner is positioned within that range. Short of that range adjacent detonation waves do not interfere sufficiently to form the elevated pressure location and beyond that range interference of the plurality of detonation waves forms a planar wave. Within this "range", the warhead (liner, main charge, boosters and initiation system) has a height H1 along the axis and a diameter D1 across the axis, wherein 0.3<=H1/D1<=0.6. By comparison, typical single SCJ warheads that form a planar wave have a ratio >1.

In an embodiment, the liner is formed with a plurality of recesses, which are aligned to the plurality of booster charges such that each recess is cut and formed into an SCJ. The thickness of each recess may be contoured to form and shape the SCJ. For example, each recess may have uniform thickness or may be thinner in the center and thicker towards the edges to encourage formation of each SCJ. Recesses must have an apex angle less than 180° and may include shallow dimples typically having an apex angle of, for example, 120-170°, or deep drawn conical structures such as conical, trumpet, "norman helmet", etc. having an apex angle of 40-120°. Each SCJ may have a tip velocity of 4-10 km/s and a penetration depth of 7-10× the recess diameter. The main charge has a height H2 along the axis and a recess diameter D2 across the axis, wherein 0.5<=H2/D2<=1.5.

In different embodiments, the plurality of booster charges may be indirectly detonated from a single point detonator or directly detonated by a plurality of individual detonators. The booster charges may be detonated simultaneously or in a timing pattern to control the formation of individual SCJs and the pattern of SCJs.

In an embodiment, the initiation system includes an inert housing having a single point initiation site and a plurality of tracks that connect the single point initiation site to the plurality of booster charges. Explosive material is placed in the plurality of tracks. A detonator at the single point initiation site produces detonation waves that travel through the explosive material in the tracks to initiate the plurality of booster charges. The plurality of tracks may be equal length to facilitate simultaneous initiation of the plurality of booster charges or different lengths to facilitate a patterned initiation of the plurality of booster charges.

In different embodiments, the warhead and explosive charges may have different geometries such as cylindrical or spherical.

These and other features and advantages of the disclosure will be apparent to those skilled in the art from the following detailed description of preferred embodiments, taken together with the accompanying drawings, in which:

DETAILED DESCRIPTION

The present disclosure provides a multiple SCJ (MSCJ) warhead in which detonation of the main charge is controlled to provide elevated pressure at multiple locations on the back surface of the liner to cut the liner and to form and propel forward a plurality of SCJs.

Figure 1A:
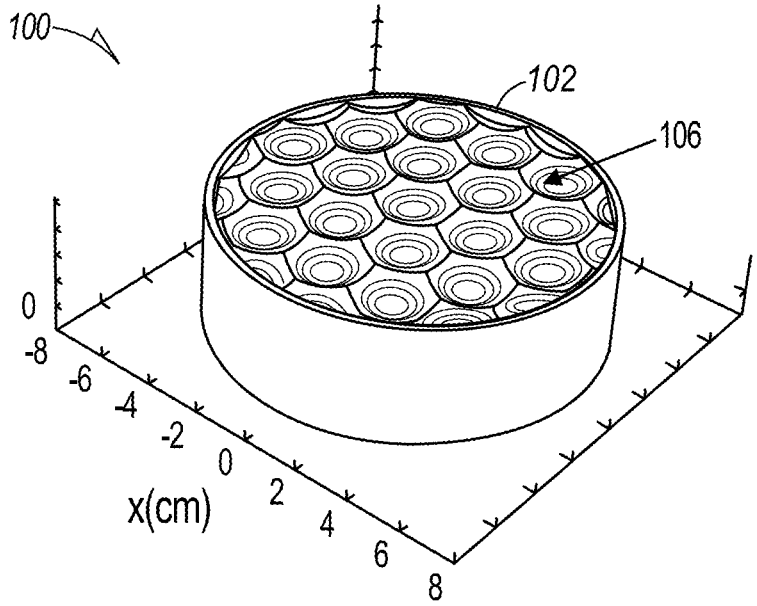
FIGS. 1A-1C are different views of an embodiment of a multiple SCJ warhead.
Figure 1B:
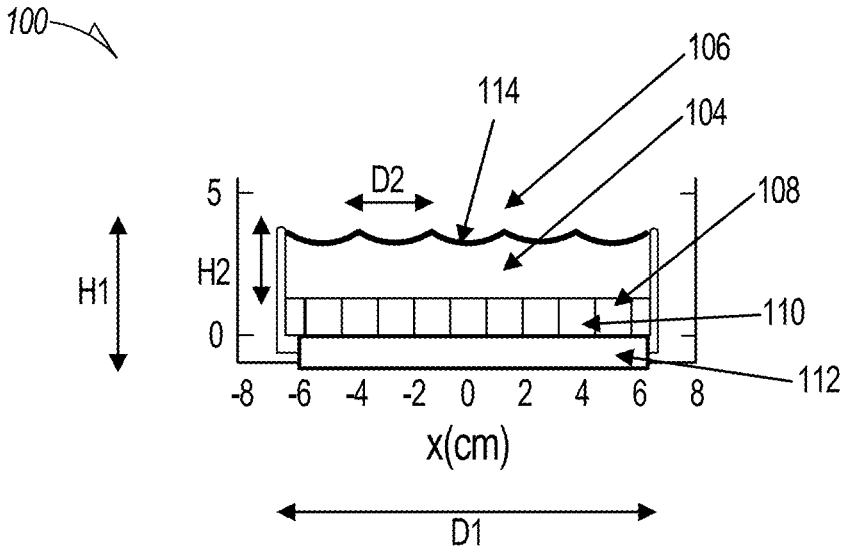
Figure 1C:
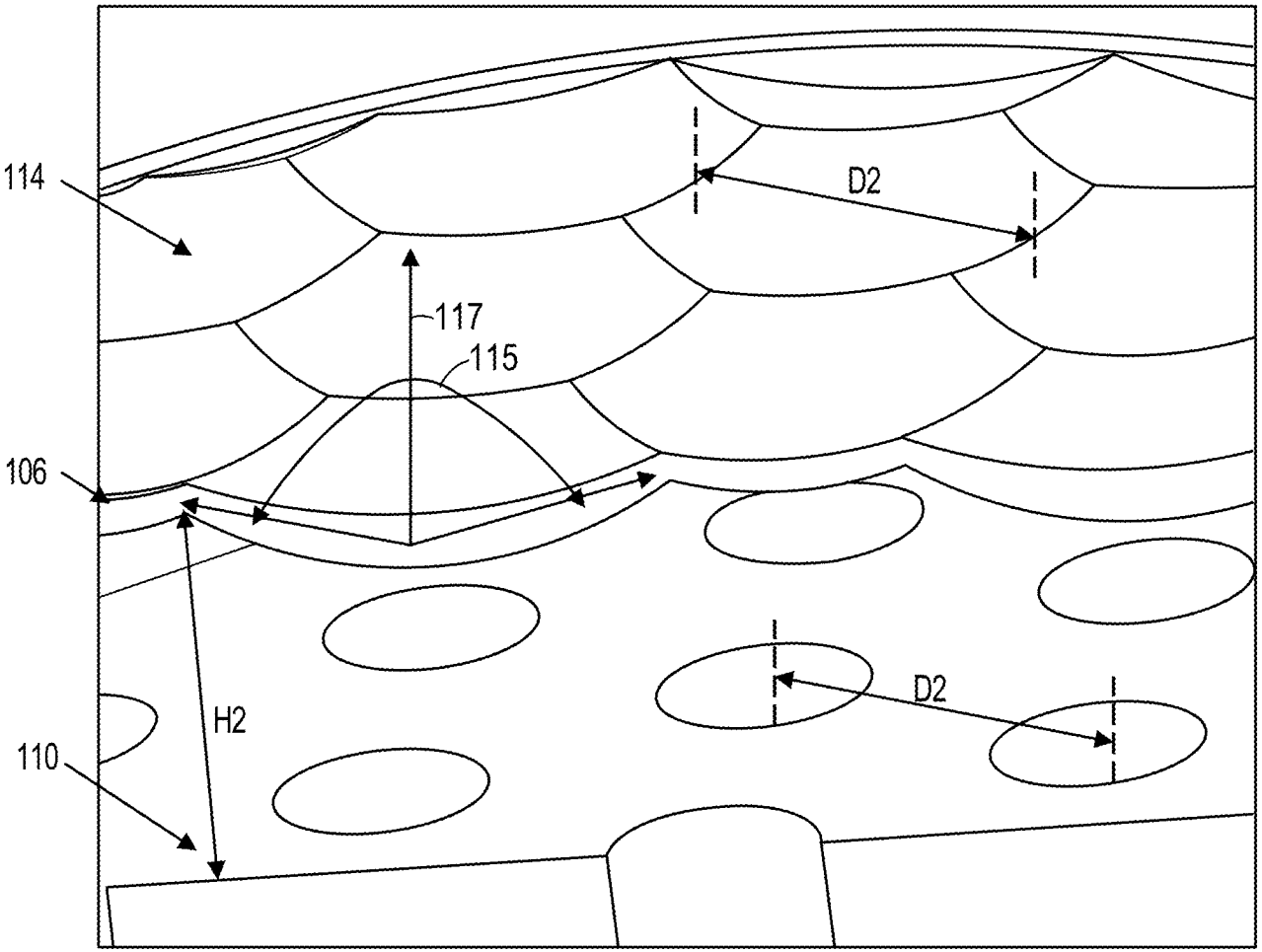

Referring now to FIGS. 1A-1C, an embodiment of a multiple SCJ warhead 100 includes a cylindrical housing 102 that contains a main charge 104, a liner 106 on a top surface of the main charge, a plurality of booster charges 108 in a booster housing 110 and spaced apart on a bottom surface of the main charge, and an initiation system 112. In this embodiment, liner 106 includes a plurality of recesses 114 in the surface of the liner. Each recess 114 has an apex angle that is less than 180° e.g., each recess exhibits a curvature, it is not flat. The amount of curvature and the thickness and contoured thickness of the recess can be controlled to form the individual SCJ. Booster charges 108 are aligned to the center of the recesses 114. Initiation system 112 is configured for multi-point initiation of the plurality of booster charges 108 to detonate the main charge 104 to produce a plurality of detonation waves that constructively interfere at multiple locations on the back surface of the liner to cut the liner and to form and propel forward a plurality of SCJs. The elevated pressures at the multiple locations are between 110% and 200% of the detonation pressure at the front of an individual detonation wave.

Pairs of directly adjacent detonation waves produce the multiple locations in a non-planar wave within a defined distance range from the plurality of booster charges. The liner is positioned within that range. Short of that range adjacent detonation waves do not interfere sufficiently to form the elevated pressure location and beyond that range interference of the plurality of detonation waves forms a planar wave. Within this "range", the warhead (liner, main charge, boosters and initiation system) has a height H1 along the axis and a diameter D1 across the axis, wherein 0.3<=H1/D1<=0.6. By comparison, typical single SCJs form a planar wave have a ratio >1. Each SCJ has a tip velocity of 4-10 km/s and a penetration depth of 7-10× the diameter of the corresponding recess. The main charge has a height H2 along the axis and a recess diameter D2 across the axis, wherein 0.5<=H2/D2<=1.5.

The plurality of booster charges may be indirectly detonated from a single point detonator or directly detonated by a plurality of individual detonators. The booster charges may be detonated simultaneously or in a timing pattern to control the formation of individual SCJs and the pattern of SCJs.

Figure 2A:
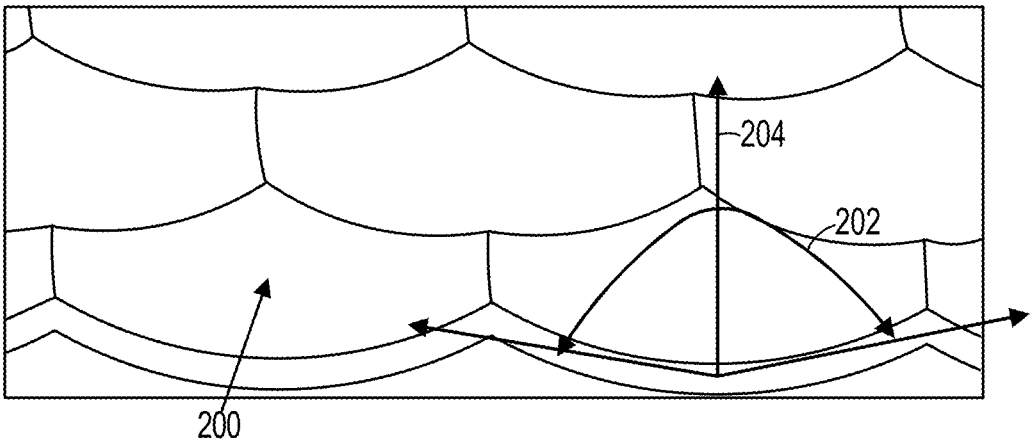
FIGS. 2A and 2B are views of different embodiments of a liner having a pattern of dimples and a liner having a pattern of conical structures, respectively.

Referring now to FIG. 2A, in one embodiment the recess is a dimple 200 e.g., a depression or indentation in the surface of the liner. The apex angle 202 is suitably 120°-170° about an axis 204 of the warhead and more typically 150-170°. Each dimple has uniform thickness in this embodiment. For example, each dimple 200 may have a radius of 1 inch and a thickness of 0.090 inches.

Figure 2B:
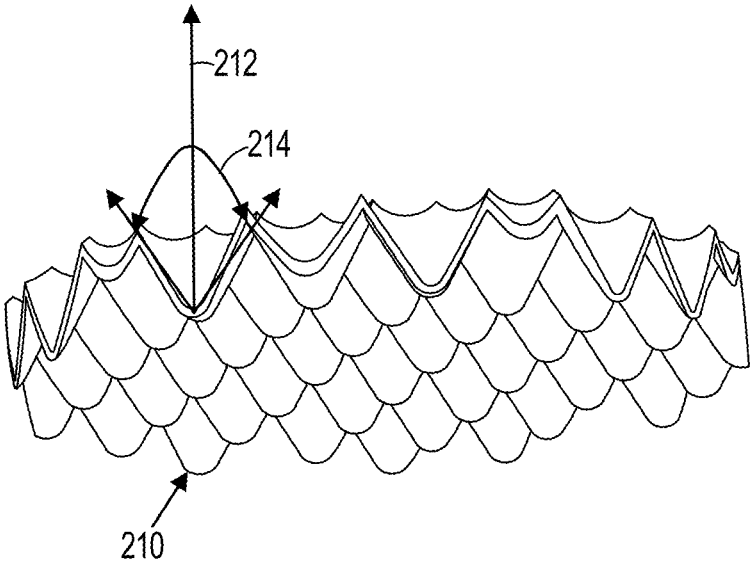

Referring now to FIG. 2B, in one embodiment the recess is a conical structure 210. The apex angle 212 is suitably 40°-120° about an axis 214 of the warhead and more typically 40-80°. Each conical structure may have uniform thickness or may be thinner at the center and thicker at the edges to better form the SCJ.

By comparison, single SCJ warheads that use a planar wave to form the liner into a SCJ typically have conical structures with an apex angle of approximately 60°. Structures with apex angles greater than 60° will not properly form into the metal jet.

The elevated pressures not only cut the liner but form each recess into a metal jet. Because the pressure levels on the edge of each recess are at least 110% of the front of the detonation wave, much shallower recesses can be formed into a SCJ. This increases the design space for the recesses in the liner and the formation of the SCJs.

Figure 3A:
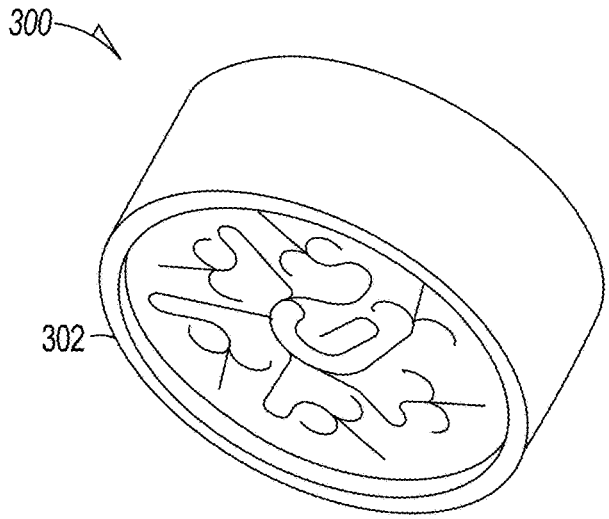
FIGS. 3A-3B are different views of an embodiment of a multi-point initiation system for the multiple SCJ warhead.
Figure 3B:
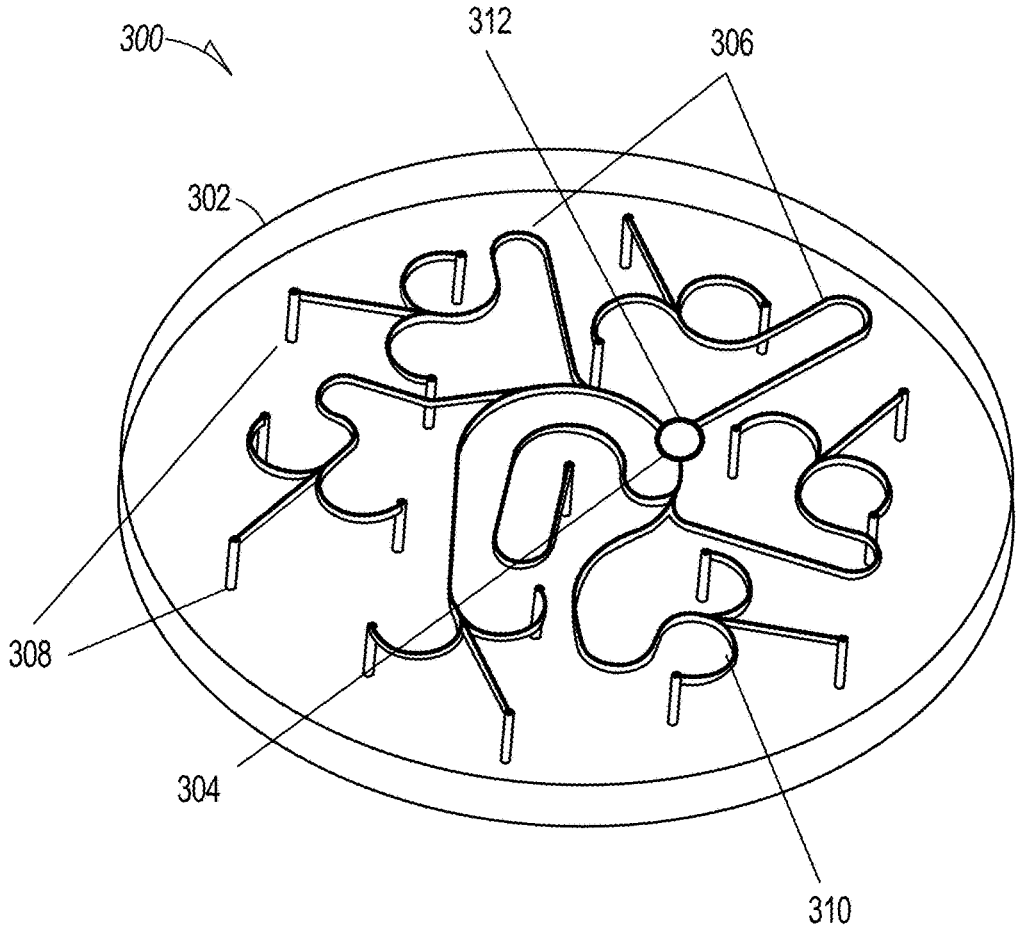
Figure 4B:
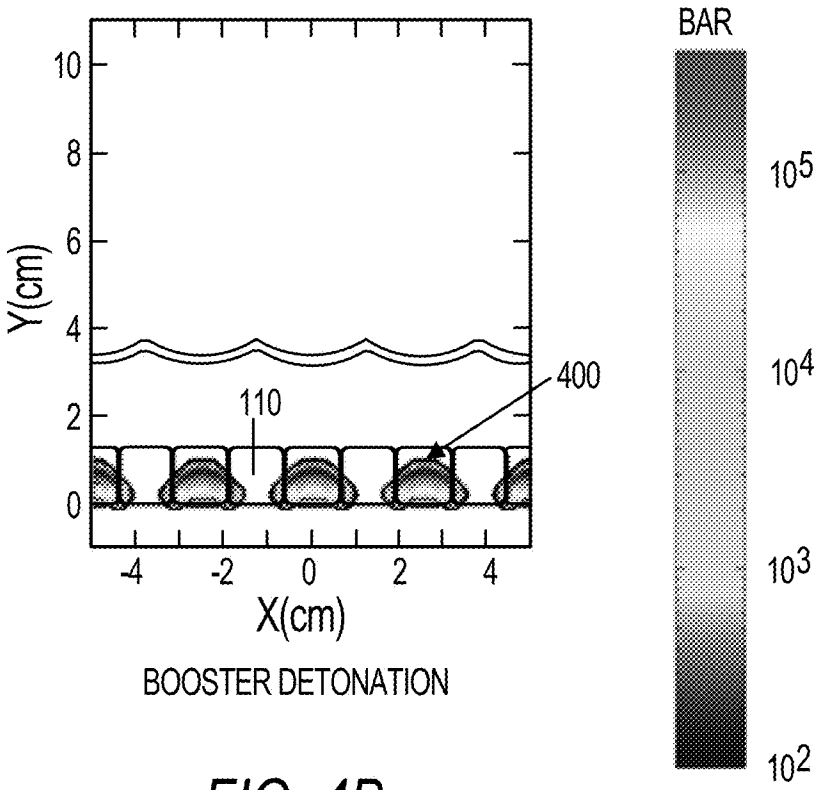
FIGS. 4A-4J are a time-series of plots illustrating a detonation sequence to form and propel multiple SCJs from a single warhead.
Figure 4A:
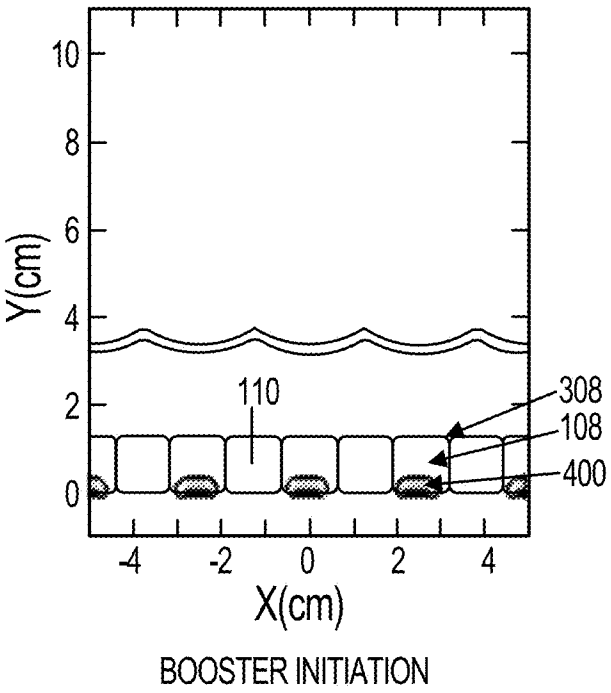
Figure 4D:
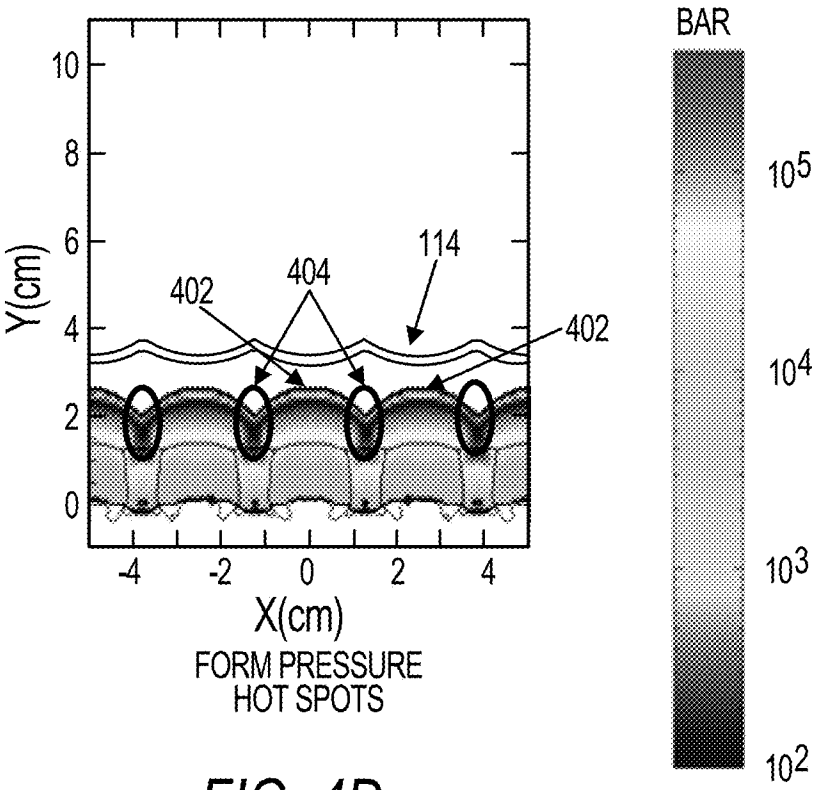
Figure 4C:
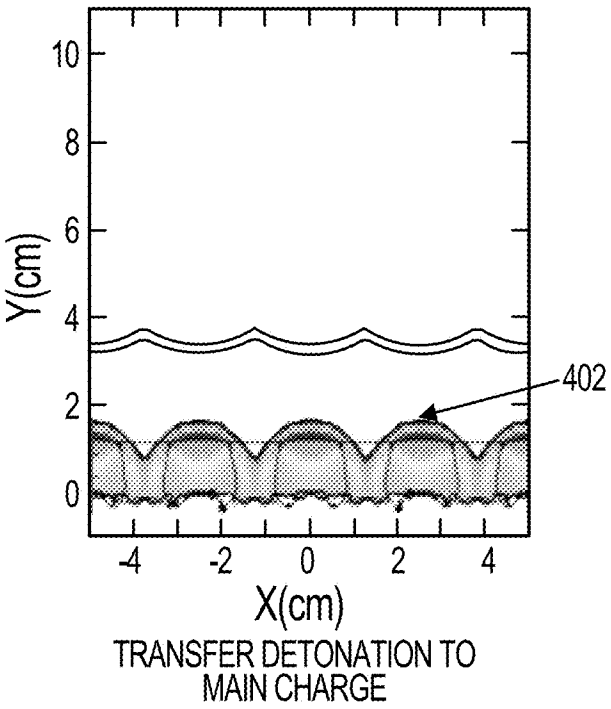
Figures 4E, 4F:
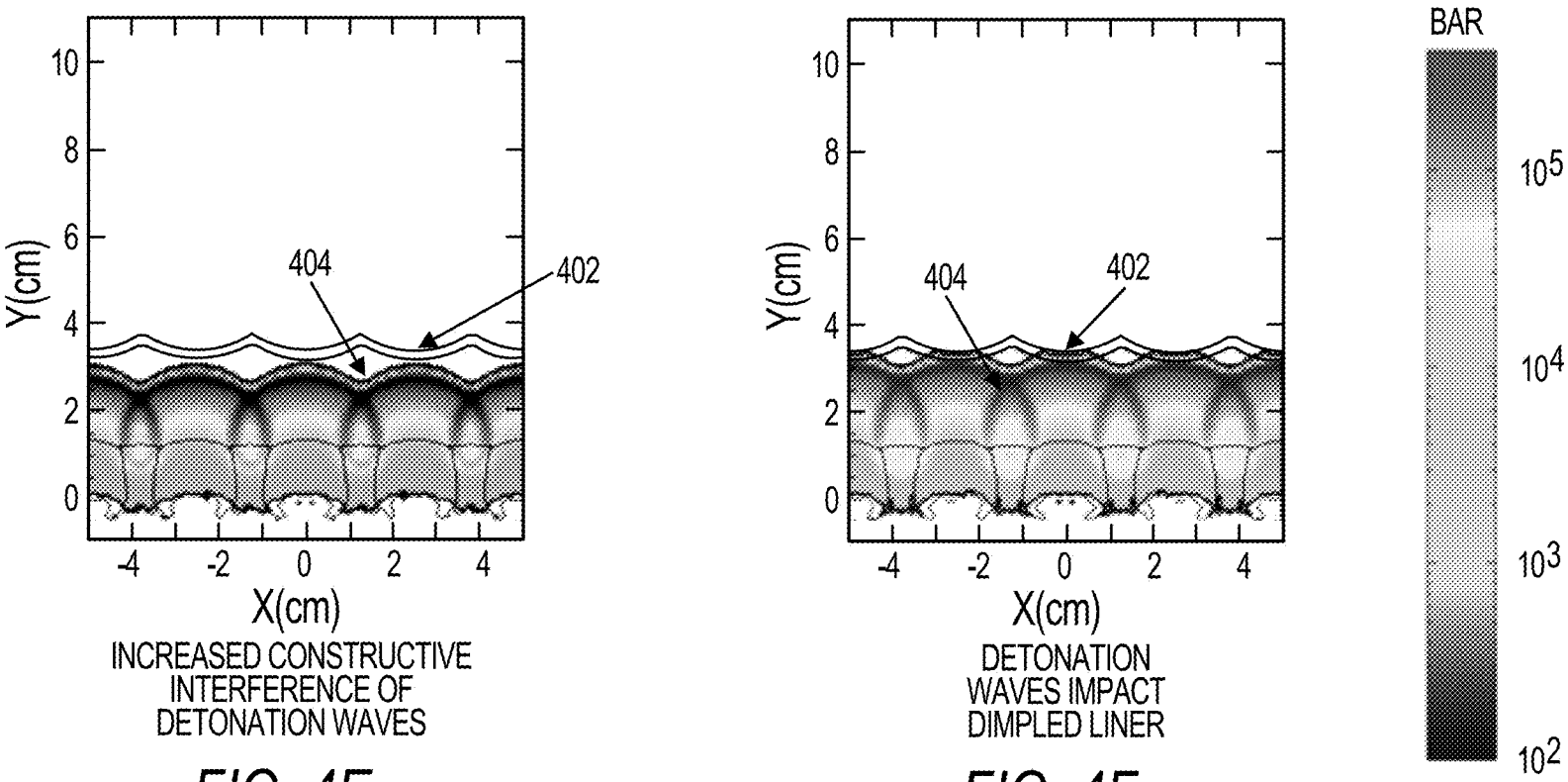
Figure 4H:
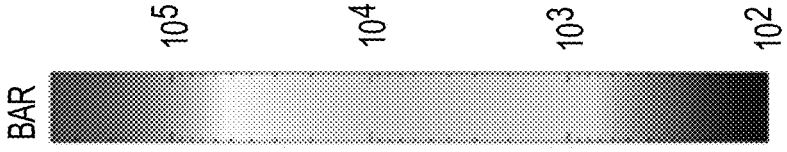
Figure 4H:
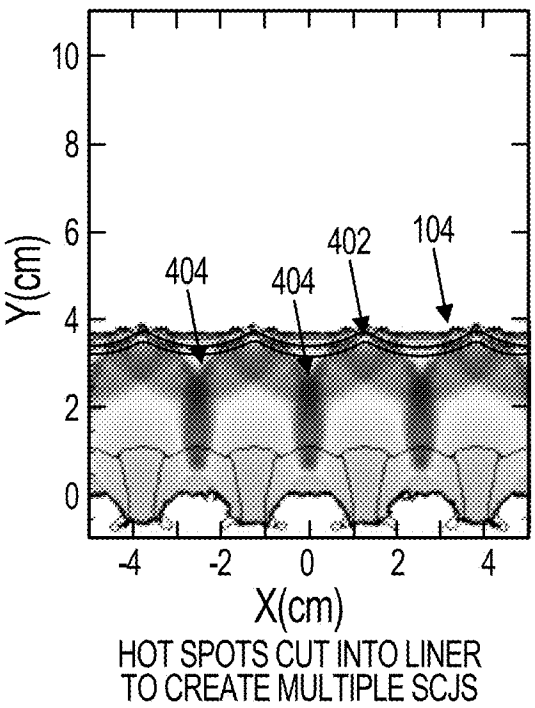
Figure 4G:
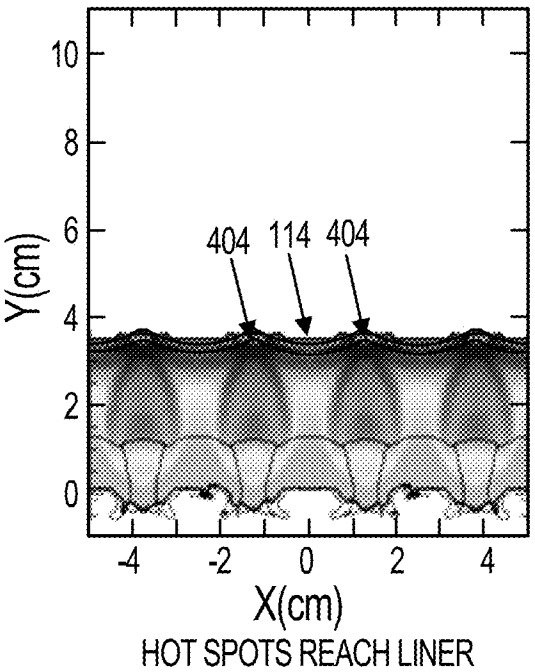
Figure 4J:
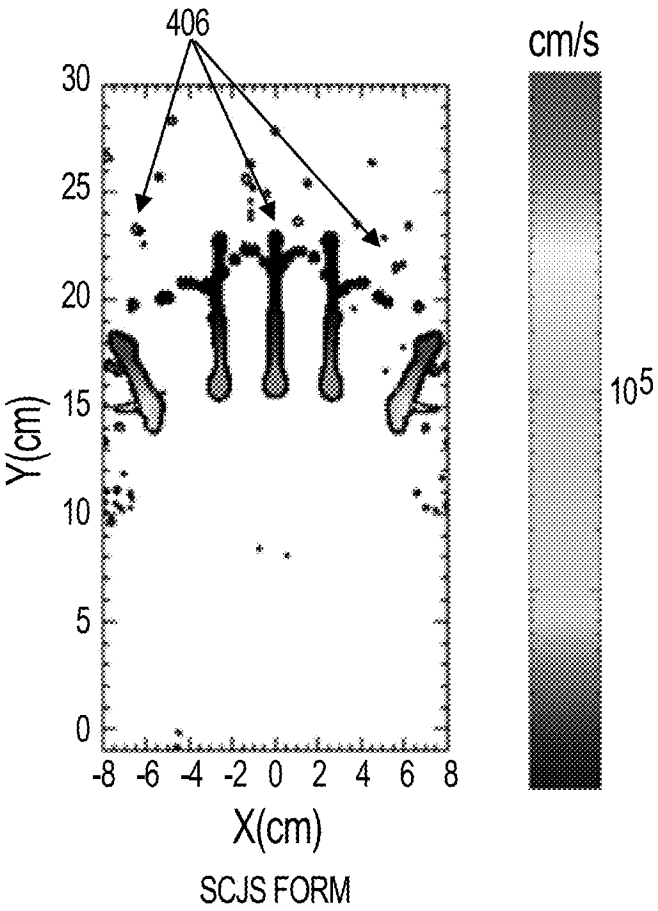
Figure 4I:
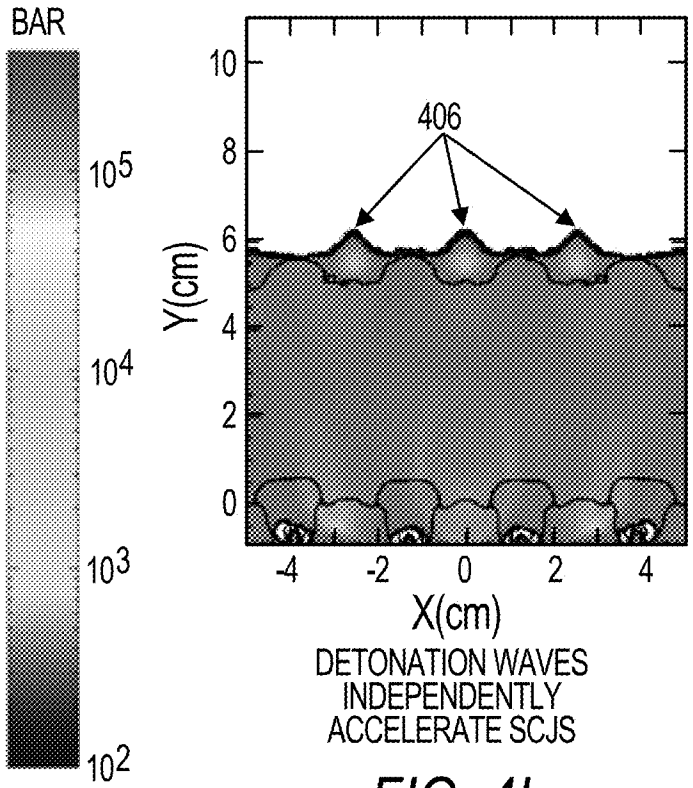

Referring now to FIGS. 3A-3B, in an embodiment, an initiation system 300 includes an inert housing 302 having a single point initiation site 304 and a plurality of tracks 306 that connect the single point initiation site to the plurality of booster charge sites 308. Explosive material 310 is placed in the plurality of tracks. A detonator 312 at the single point initiation site produces detonation waves that travel through the explosive material 310 in the tracks to the booster charge sites 308 initiate the plurality of booster charges. The plurality of tracks may be equal length to facilitate simultaneous initiation of the plurality of booster charges or different lengths to facilitate a patterned initiation of the plurality of booster charges.

Referring now to FIGS. 4A-4J, in an embodiment, the plurality of boosters 108 are simultaneously initiated by the initiation system to initiate booster waves 400 that continue forward within the booster charge sites 308 within the inert housing 110. Booster waves 400 transfer detonation to main charge 104 to form detonation waves 402 that propagate forward through main charge 104. As each detonation waves 402 constructively interferes with the directly adjacent detonation wave 402, hot spots 404 of elevated pressure are defined at multiple locations that are approximately aligned to the edges of dimples 114. As previously described, the hot spots 404 form within a distance range from the boosters. If the liner is too close to the boosters 108 that hot spots 404 will have not yet formed. If the liner is too far away, the plurality of detonation waves 402 will interfere and level off into a single planar wave. The front of each detonation wave 402 impacts the bottom of each dimple and then the hot spots 404 reach the liner at the edges of the dimples 114 and cut into the liner 106 to form multiple SCJs 406, one for each dimple 114. The detonation waves 402 independently accelerate and form each SCJ 406, which are propelled forward.

In comparison to existing single SCJs that produce a planar detonation wave to form the SCJ, the current design requires a main charge with less height H2, hence less volume to form the elevated pressure hot spots. Furthermore, formation of the hot spots to cut the individual dimples or conical structures produces SCJs that are better and more uniformly formed than a single planar detonation wave. Lastly, the current design produces multiple SCJs in a single warhead.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. A warhead having a height H1 along an axis and a diameter D1, comprising:

a main charge;

a liner on a top surface of the main charge;

a plurality of booster charges spaced apart on a bottom surface of the main charge; and an initiation system configured for multi-point initiation of the plurality of booster charges to detonate the main charge to produce a plurality of detonation waves;

wherein the liner is positioned within a defined range from the plurality of booster charges equal to a height H2 of the main charge along the axis in which 0.3<=H1/D1<=0.6 such that pairs of directly adjacent detonation waves constructively interfere to form elevated pressures at multiple locations on the back surface of the liner to cut the liner and to form and propel forward a plurality of shaped charge jets (SCJs).

2. The warhead of claim 1, wherein the elevated pressures at the multiple locations is at least 110% a detonation pressure at the front of the detonation waves between the locations.

3. The warhead of claim 2, wherein the elevated pressures at the multiple locations is up to 200% of the detonation pressure.

4. The warhead of claim 1, wherein the liner includes a plurality of recesses, wherein the plurality of booster charges are aligned to the centers of the recesses such that each recess is cut and formed into a SCJ.

5. The warhead of claim 1, wherein each SCJ has a tip velocity of 4-10 km/s and a penetration depth of 7-10× a diameter of the corresponding recess.

6. The warhead of claim 4, wherein each recess has an apex angle of less than 180°.

7. The warhead of claim 4, wherein each recess is a dimple having an apex angle of 120-170°.

8. The warhead of claim 4, wherein each recess is a conical structure having an apex angle 40-120°.

9. The warhead of claim 4, wherein each recess has a recess diameter D2 across the axis, wherein 0.5<=H2/D2<=1.5.

10. The warhead of claim 1, wherein the initiation system comprises:

an inert housing including a single point initiation site and a plurality of tracks that connect the single point initiation site to the plurality of booster charges;

explosive material in the plurality of tracks; and a detonator at the single point initiation site, wherein initiation of the detonator produces detonation waves that travel through the explosive material in the tracks to initiate the plurality of booster charges.

11. The warhead of claim 10, wherein the plurality of tracks are equal length to facilitate simultaneous initiation of the plurality of booster charges.

12. A warhead having a height H1 along an axis and a diameter D1, said warhead comprising:

a main charge having a height H2;

a liner on a top surface of the main charge, said liner having a plurality of recesses each having a diameter D2 and an apex angle less than 180°;

a plurality of booster charges spaced apart on a bottom surface of the main charge and aligned to centers of the plurality of recesses; and an initiation system configured for multi-point initiation of the plurality of booster charges to detonate the main charge produce a plurality of detonation waves;

wherein the liner is position within a defined range H2 from the plurality of booster charges in which 0.3<=H1/D1<=0.6 and 0.5<=H2/D2<=1.5 such that pairs of directly adjacent detonation waves constructively interfere to form elevated pressures at multiple locations on the back surface of the liner at the edges of the recesses to cut the liner and to form the recesses into a plurality of shaped charge jets (SCJs) that are propelled forward.

13. The warhead of claim 12, wherein the elevated pressures at the multiple locations between 110% and 200% of a detonation pressure at the front of the detonation waves between the multiple locations.

14. The warhead of claim 12, wherein each recess is a dimple having an apex angle of 120-170° or a conical structure having an apex angle of at most 40-120°.

15. A warhead having a height H1 along an axis and a diameter D1, comprising:

a main charge;

a liner on a top surface of the main charge, said liner having a plurality of recesses;

a plurality of booster charges spaced apart on a bottom surface of the main charge and aligned to centers of the plurality of recesses; and an initiation system including an inert housing having a single point initiation site and a plurality of tracks that connect the single point initiation site to the plurality of booster charges, explosive material in the plurality of tracks and a detonator at the single point initiation site, wherein initiation of the detonator produces detonation waves that travel through the explosive material in the tracks to initiate the plurality of booster charges to detonate the main charge and produce a plurality of detonation waves;

wherein the liner is positioned at a defined range from the plurality of booster charges equal to a height H2 of the main charge along the axis in which 0.3<=H1/D1<=0.6 such that pairs of directly adjacent detonation waves constructively interfere to form elevated pressures at multiple locations on the back surface of the liner at a pressure between 110% and 200% of a detonation pressure of a single detonation wave to cut the liner and to form and propel forward a plurality of shaped charge jets (SCJs).

16. The warhead of claim 14, wherein each recess is a dimple having an apex angle of 120-170° or a conical structure having an apex angle of at most 40-120°.

* * * * *